US005147971A

United States Patent [19]

Bartolles

[11] Patent Number: 5,147,971

[45] Date of Patent: Sep. 15, 1992

[54] BASE AND OBTURATING RING ARRANGEMENT

[75] Inventor: Rolf Bartolles, Korschenbroich, Fed. Rep. of Germany

[73] Assignee: Rheinmetall GmbH, Dusseldorf, Fed. Rep. of Germany

[21] Appl. No.: 647,746

[22] Filed: Jan. 30, 1991

[30] Foreign Application Priority Data

Feb. 28, 1990 [DE] Fed. Rep. of Germany ..... 4006215

[51] Int. Cl.[5] ..... F41A 3/74

[52] U.S. Cl. ..... 89/26

[58] Field of Search ..... 89/26

[56] References Cited

U.S. PATENT DOCUMENTS 4,022,104 5/1977 Politzer et al. .

5,054,366 10/1991 Bartolles ..... 89/26

FOREIGN PATENT DOCUMENTS

A10251902 10/1989 European Pat. Off. .

1094825 12/1967 United Kingdom .

1273036 5/1972 United Kingdom ..... 89/26

OTHER PUBLICATIONS

"Handbook on Weaponry", 2nd English Edition, 1982, pp. 340–341.

*Primary Examiner*—Stephen C. Bentley

*Attorney, Agent, or Firm*—Spencer, Frank & Schneider

[57] ABSTRACT

An obturating arrangement for a gun barrel of the type having a right-angled obturating ring having its axially extending arm disposed within a recess in the base ring at the end of the gun barrel and its inwardly radially extending arm engaging, in a known manner, a breechblock wedge insert. In known arrangements of this type powder residues generated during firing, which may accumulate in the recess of the base ring and become lodged underneath the supporting face of the obturating ring arm projecting into the recess, may cause the basic play between the obturating ring and the breechblock wedge insert to be reduced, so that malfunctions during the closing of the breechblock wedge may occur. To overcome these drawbacks and also to increase operational reliability and lengthen the time between cleanings, the free end of the obturating ring arm projecting into the recess is arranged at a distance from the base surface of the recess while the rearwardly projecting end of the bead defining the inner wall of the recess is configured as a support for the obturating ring. The free end of the arm projecting into the recess preferably includes a sloped surface tapering toward the exterior of the obturating ring, and thus produces a stripping effect. Powder residues possibly still present in the enlarged volume of the recess can be blown out by fast flowing gases passing through a reduced opening between the bead end and the radially disposed arm.

17 Claims, 1 Drawing Sheet

BASE AND OBTURATING RING ARRANGEMENT

BACKGROUND OF THE INVENTION

The present invention relates to an obturating arrangement for the breech end of a barrel of a gun having a wedge type breechblock. More particularly the present invention relates to a base ring provided with a right-angled obturating ring having a first arm, which extends parallel to the longitudinal axis of the gun barrel, and thus of the base ring, projecting into a recess delimited by a bead of the base ring and, in order to provide obturation, having its exterior face lying against the outer axially extending abutment surface of the recess, and having a second arm, which is arranged at a right angle to the gun barrel and to the first arm, extending radially inwardly beyond said bead so that its exterior surface can lie against an insert of a breechblock wedge to provide obturation.

Such an obturating ring arrangement is disclosed in the book, entitled "Handbook on Weaponry", published by Rheinmetall GmbH, Düsseldorf, 2nd English Edition, 1982, page 340, FIG. 862.

The arm of this obturating ring which projects into a recess in the base ring is axially supported at the base surface of the recess. The bottom of the base ring is difficult to clean, and thus sometimes it is possibly insufficiently cleaned so that the powder residue generated by the firing of a round and deposited at the bottom of the base ring may creep underneath the supporting face of the arm and, in a disadvantageous manner, reduce the basic play of the obturating ring relative to the breechblock wedge. This can possibly compress the breechblock wedge before it reaches its final position and prevent it from performing a complete closing stroke.

SUMMARY OF THE INVENTION

It is an object of the present invention to improve the obturating arrangement in the base ring such that the closing function is ensured to operate in a manner not susceptible to malfunctions.

The above object is generally achieved according to the present invention by an obturating arrangement for the breech end of a barrel of a gun having a wedge type breechblock, with the arrangement including a base ring having an end surface with an annular recess whose inner wall is delimited by an axially extending bead and whose outer wall extends substantially parallel to a longitudinal axis of the ring, and a right-angled obturating ring having first and second arms whose respective exterior surfaces are flat and are substantially perpendicular, with the first arm extending into the recess and having its exterior surface abutting the outer surface of the recess, and with the second arm extending radially inwardly from the first arm beyond an outer end of the bead so that its exterior surface can lie against an insert of a wedge type breechblock to provide obturation; and wherein: the end of the bead is configured as an abutment for, and normally abuts, the second arm of the obturating ring, and the length of the first arm is such that a free end of the first arm is axially spaced from the base surface of the recess.

According to the invention, the obturating ring is no longer supported on the sealing lip of the axially arranged arm at the bottom of the recess in the base ring. Rather its radially extending arm lies against the rearwardly projecting end of a bead of the base ring where it delimits the recess.

During firing, this radial arm lays itself against the breechblock wedge insert in an obturating manner so that a minimum amount of basic play, for example 0.1 mm to 0.2 mm, appears in the interior between the radial arm and the end of the bead. During firing, the small amount of basic play between the bead and the radial arm causes the gas to take on a high velocity so that powder residues within the base ring recess are substantially blown away, and a self-cleaning effect is produced from round to round.

The present invention further provides that the free end of the axially arranged arm of the obturating ring is spaced from the base surface of the recess. This enhances the self-cleaning effect and prevents jamming of the combustion residues in the recess underneath the end of the arm, so that axial displacement of the obturating ring in the direction of the breechblock wedge caused by powder residues is impossible. In an advantageous manner, the novel configuration of the obturating system according to the present invention makes the breechblock system immune to malfunctions to a great degree.

Additionally, maintenance of the sealing system is simplified so that the number of rounds to be fired until the sealing system should be checked is increased considerably, and thus the operational reliability of the breechblock is also significantly improved.

According to one feature, the arm end projecting into the recess, i.e, the axially arranged arm, is provided with a slope which tapers toward the exterior surface of the obturating ring so that this arm, due to its axial mobility within the basic play, acts as a dirt rejecter and thus excludes the accumulation of powder residues on the abutment surface of the recess.

The distance between the lower free end of the sloped face of the obturating arm and the bottom of the recess is at least 1 mm. Additionally, a rounded configuration of the bottom of the recess provides a good self-cleaning effect.

The present invention will be described in greater detail below with reference to an embodiment thereof that is illustrated in the drawing figures.

DETAILED DESCRIPTION OF THE PREFERRED EMBODIMENTS

Figure 1:
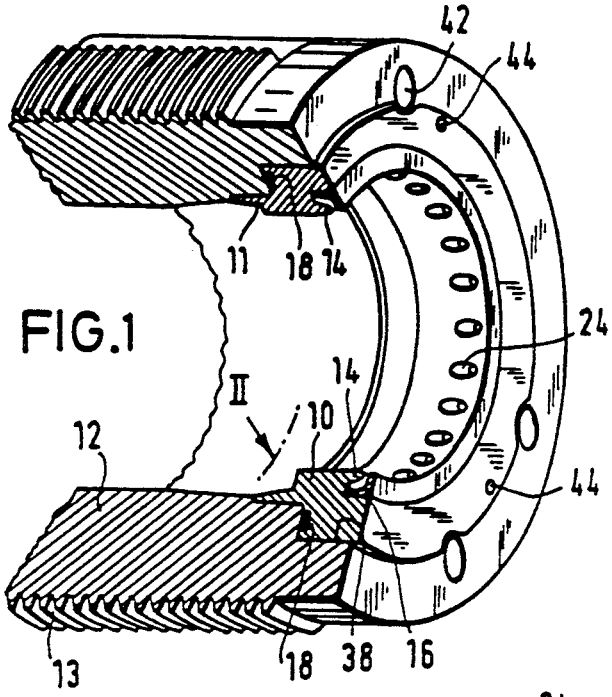
FIG. 1 is a perspective view, partially in section, of the end of a gun barrel including a base ring and an obturating ring.
Figure 2:
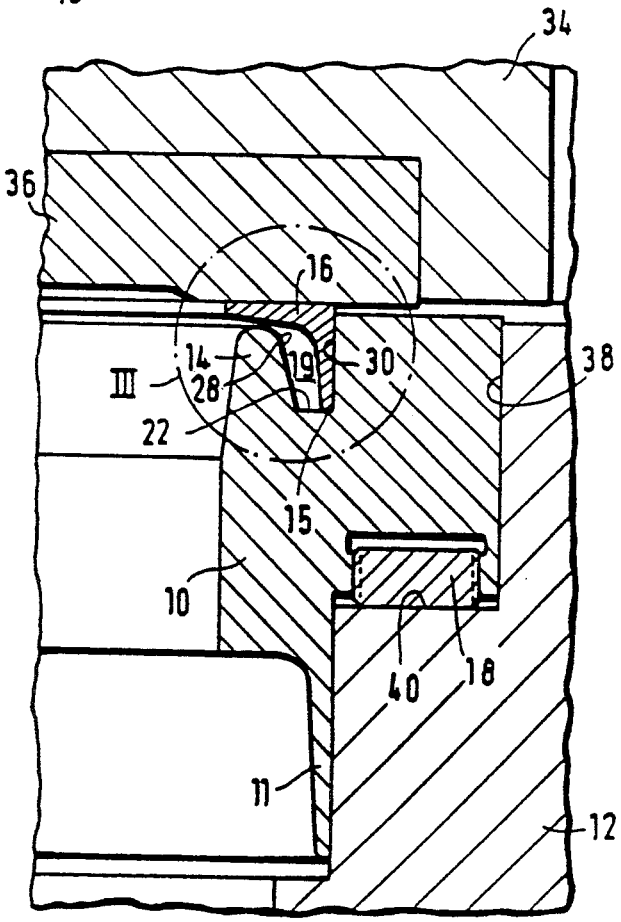
FIG. 2 is a sectional view, to a larger scale, along the line marked II in FIG. 1 showing a conventional sealing system.

FIGS. 1 and 2 illustrate the rear end of a gun barrel 12 and the obturating arrangement between a breechblock wedge 34, which is displaceable transversely to gun barrel 12 within a breech ring (not shown in detail). Gun barrel 12 is provided with an external thread 13 for fastening the breech ring and, at its rear end, with a recess 38 in its interior for accommodating a base ring 10 equipped with right-angled obturating ring 16. The base ring 10 is fastened to the gun barrel 12 by means of screws 42.

FIG. 2 shows the breechblock wedge 34 in the closed position in which a breechblock wedge insert 36 constitutes the abutment face for the obturating ring 16 which is mounted in a recess 19 in the end surface of base ring 10. The detail marked III in FIG. 2 illustrates the prior art arrangement of the right-angled obturating ring 16 within base ring 10. The arm of obturating ring 16 disposed parallel to the longitudinal axis of gun barrel 12, and thus of the base ring 10, projects into a recess 19 which is formed in the end surface of ring 10 and has its inner wall 28 defined by a sloped inner surface of a bead 14 of base ring 10. The free end 15 of this arm is supported on the base surface 22 of the recess 19 while its exterior surface lies against an axially extending abutment surface 30 defining the outer wall of recess 19. In order to provide obturation, the other arm of ring 16, i.e., the arm arranged at a right angle to gun barrel 12, extends radially inwardly beyond the free end of bead 14 so that its exterior surface, which forms a right angle with the exterior surface of the other axially extending arm, can lie against an insert 36 of breechblock wedge 34.

In the conventional manner shown in FIG. 2, the depth of the recess 19 in base ring 10, which extends to base surface 22, is shorter than the length of the arm of obturating ring 16 disposed parallel to the axis of the gun barrel. A basic play of 0.1 mm to 0.2 mm required between the arm of obturating ring 16 extending radially to gun barrel 12 and breechblock wedge insert 36 in order to perform the transverse movements of the breechblock wedge 34 required to open and close the chamber in gun barrel 12 can be set by displacing base ring 10 in the axial direction.

A threaded ring 18 is provided for setting the axial play required between the radial arm of obturating ring 16 and the breechblock wedge insert 36. This threaded ring 18 faces gun barrel 12 and is supported on an abutment face 40 of recess 38. The ring 18 can be screwed axially into an annular groove within base ring 10. Such a ring 18 has already been disclosed in Federal Republic of Germany Patent Application Serial No. P 39 22 334.5 corresponding to U.S. application Ser. No. 07/528,428, filed May 25th, 1990, now U.S. Pat. No. 5,054,366 issued Oct. 18th, 1991.

Figure 3:
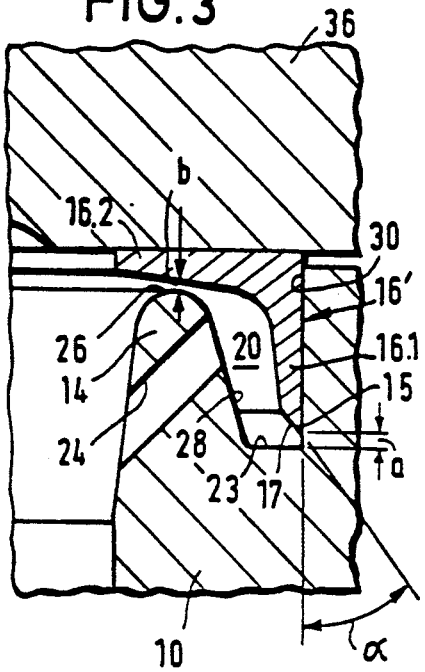
FIGS. 3 and 4 are enlarged detail views of the area marked at III in FIG. 2, illustrating two possible variations of the sealing system according to the present invention.
Figure 4:
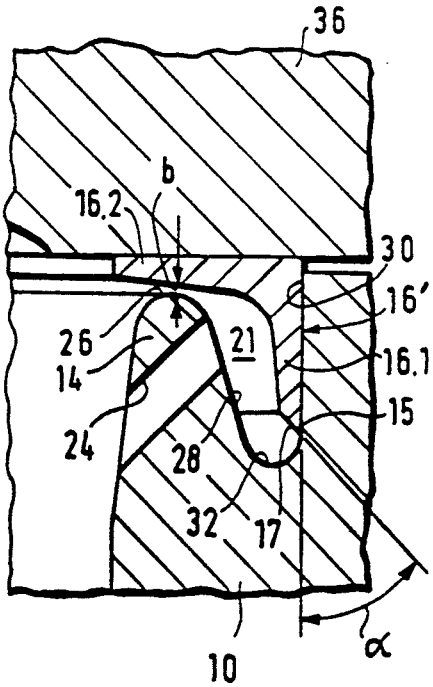

The bead 14 of base ring 10 includes a plurality of bores 24 shown in FIGS. 1, 3 and 4 which connect recess 19, 20 and 21 respectively, with the chamber of gun barrel 12. Thus, when a shot is fired, obturating ring 16 is charged with gas pressure directly in recess 19 via the bores 24.

On its side facing the gun barrel chamber, base ring 10 ends in a narrow obturating lip 11 which lies against the interior surface of the gun barrel. The base ring 10 can easily be released out of recess 38 of gun barrel 12 by means of a plurality of forcing screws 44.

In contrast to the conventional arrangement of the obturating system shown in FIG. 2, the obturating ring 16' according to the present invention, as shown in FIG. 3, when not stressed, no longer has the free end 15 of its axially parallel arm 16.1 normally resting on the base surface 23 or 32 of the recess 20 or 21, respectively, formed in the base ring 10. Rather, the relationship between the depth of the recess 20 or 21, the length of the arm 16.1 and the height of the end 26 of bead 14 are such that the interior surface of the radially extending arm 16.2 normally lies against the rearwardly projecting free end 26 of the bead 14 serving as a support.

FIGS. 3 and 4 show the obturating ring 16' in a pressure charged position in which it lies against breechblock wedge insert 36 and is spaced, in contrast to the prior art comparatively large distance between the bead end 26 and the interior surface of radially extending arm 16.2, at a distance b which has been reduced to the value of the basic play of 0.1 mm to 0.2 mm.

The free end 15 of arm 16.1 of obturating ring 16' where it projects into recess 20 or 21 is spaced from the base surface of the recess at a distance a which is at least 1 mm, and preferably 2 to 5 mm.

The distance b, which is reduced to the basic play according to the present invention, now substantially prevents, compared to the above described prior art embodiments, the direct penetration of powder residues and, due to the already described advantageous effect of the high gas velocity during firing, produces a self-cleaning effect within recesses 20 and 21.

Moreover, the free end 15 of arm 16.1 of obturating ring 16' where it projects into recess 20, 21 preferably is configured as a dirt stripper. For this purpose, the end 15 of the arm is given a sloped inner surface 17 which is oriented toward the exterior surface of obturating ring 16'. This sloped surface 17 forms an angle $\alpha$ between 30° and 60° with the exterior surface of the arm 16.1, so that a good striping effect is produced for possibly existing powder residues. The accumulation of disadvantageous powder residues underneath the frontal or end surface of arm 16.1 is additionally avoided in that the distance a of the free end 15 of obturating ring arm 16.1 from the base surfaces of recess 20 or 21 is more than 1 mm. The shape of the base surface may be flat as shown for surface 23 of FIG. 3 or have an outwardly rounded shape, i.e., base surface 32 of FIG. 4. In both cases, possibly existing powder residues at abutment surface 30 are stripped off by sloped surface 17 and are substantially blown away by the gases flowing in at a great velocity. The large dirt accumulation volume given by distance a between arm end 15 and base surface 23 ensures that long checking and cleaning intervals are sufficient.

The invention now being fully described, it will be apparent to one of ordinary skill in the art that any changes and modifications can be made thereto without departing from the spirit or scope of the invention as set forth herein.

What is claimed is:

1. In an obturating arrangement for the breech end of a barrel of a gun having a wedge type breechblock, said arrangement including a base ring having an end surface with an annular recess whose inner wall is delimited by an axially extending bead of said ring and whose outer wall extends substantially parallel to a longitudinal axis of said ring, and a right-angled obturating ring having first and second arms whose respective exterior surfaces are flat and are substantially perpendicular, with said first arm extending into said recess and having its said exterior surface abutting said outer surface of said recess, and with said second arm extending radially inwardly from said first arm beyond an outer end of said bead so that its said exterior surface can lie against an insert of a wedge type breechblock to provide obturation; the improvement wherein: said end of said bead is configured as an abutment for, and normally abuts, said second arm of said obturating ring, and the length of said first arm is such that a free end of said first arm is axially spaced from a base surface of said recess.

2. An obturating arrangement as defined in claim 1 wherein said free end of said first arm has a sloped inner surface which tapers toward and intersects said exterior surface of said first arm of said obturating ring.

3. An obturating arrangement as defined in claim 2 wherein said sloped surface of said first arm of said obturating ring forms an angle $\alpha$ of between 30° and 60° with said exterior surface of said first arm.

4. An obturating arrangement as defined in claim 2 wherein the axial spacing between said free end of said first obturating ring arm from said base surface of said recess is at least one millimeter.

5. An obturating arrangement as defined in claim 4 wherein said base surface of said recess of said base ring has an outwardly rounded shape.

6. An obturating arrangement as defined in claim 2 wherein said base surface of said recess of said base ring has an outwardly rounded shape.

7. An obturating arrangement as defined in claim 1 wherein the axial spacing between said free end of said first obturating ring arm from said base surface of said recess is at least one millimeter.

8. An obturating arrangement as defined in claim 1 wherein said base surface of said recess of said base ring has an outwardly rounded shape.

9. In an obturating arrangement for the breech end of a barrel of a gun having a wedge type breechblock, said arrangement including a base ring mounted on the breech end of the gun barrel and having an end surface with an annular recess whose inner wall is delimited by an axially extending bead of said base ring and whose outer wall extends substantially parallel to a longitudinal axis of said base ring, a plurality of openings extending through said bead, and a right-angled obturating ring having first and second arms whose respective exterior surfaces are flat and are substantially perpendicular, with said first arm extending into said recess and having its said exterior surface abutting said outer surface of said recess, and with said second arm extending radially inwardly from said first arm beyond an outer end of said bead so that its said exterior surface lies against an insert of the wedge type breechblock to provide obturation when said obturating ring is charged with gas pressure via said openings and moves axially relative to said end of said bead; the improvement wherein: said end of said bead is configured as an abutment for said second arm of said obturating ring which normally abuts said end of said bead when not charged with gas pressure, and the length of said first arm is such that a free end of said first arm is axially spaced from a base surface of said recess.

10. An obturating arrangement as defined in claim 9 wherein the height of said bead is such that said exterior surface of said radially extending arm is spaced by a minimum basic play from the insert of the wedge type breechblock when said obturating ring is not charged with gas pressure and abuts said outer end of said bead, whereby a space corresponding to said minimum basic play will be produced between said end of said bead and said radially extending arm of said obturating ring when said obturating ring is charged with gas pressure.

11. An obturating arrangement as defined in claim 10 wherein said basic play is 0.1 to 0.2 mm.

12. An obturating arrangement as defined in claim 9 wherein said free end of said first arm has a sloped inner surface which tapers toward and forms an acute angle $\alpha$ with said exterior surface of said first arm of said obturating ring.

13. An obturating arrangement as defined in claim 12 wherein said sloped surface of said first arm of said obturating ring forms an angle $\alpha$ of between 30° to 60° with said exterior surface of said first arm.

14. An obturating arrangement as defined in claim 12 wherein the axial spacing between said free end of said first obturating ring arm from said base surface of said recess is at least one millimeter.

15. An obturating arrangement as defined in claim 14 wherein said base surface of said recess of said base ring has an outwardly rounded shape.

16. An obturating arrangement as defined in claim 12 wherein said base surface of said recess of said base ring has an outwardly rounded shape.

17. An obturating arrangement as defined in claim 9 wherein said base surface of said recess of said base ring has an outwardly rounded shape.

* * * * *